US007770669B1

(12) United States Patent
Desrochers et al.

(10) Patent No.: US 7,770,669 B1
(45) Date of Patent: Aug. 10, 2010

(54) AUGER AND HOLE STABILIZATION COMBINATION SYSTEM

(76) Inventors: Robert W. Desrochers, 61 Diamond Hill Rd., North Berwick, ME (US) 03906; Bonnie J. Daigle, 61 Diamond Hill Rd., North Berwick, ME (US) 03906

( * ) Notice: Subject to any disclaimer, the term of this patent is extended or adjusted under 35 U.S.C. 154(b) by 0 days.

(21) Appl. No.: 12/264,625

(22) Filed: Nov. 4, 2008

(51) Int. Cl.
*E21B 7/20* (2006.01)
*E21B 7/26* (2006.01)

(52) U.S. Cl. ..... 175/257; 175/171; 175/23; 405/249

(58) Field of Classification Search ..... 175/171, 175/23, 257, 19; 405/249
See application file for complete search history.

(56) References Cited

U.S. PATENT DOCUMENTS 101,925 A * 4/1870 Sandbach et al. ..... 175/316
693,801 A 2/1902 Leaverton
2,735,703 A 2/1956 Goodman
3,696,625 A 10/1972 Alexander
4,553,612 A 11/1985 Durham
4,672,901 A 6/1987 Stine
D306,247 S 2/1990 Shields
D307,496 S 4/1990 Moss
5,066,168 A * 11/1991 Holdeman ..... 405/249
5,067,570 A 11/1991 Gilcrease
6,142,712 A * 11/2000 White et al. ..... 405/249
6,296,068 B1 10/2001 Frederick
6,752,219 B1 6/2004 Fridd
7,413,035 B1 * 8/2008 Miller ..... 175/171

* cited by examiner

*Primary Examiner*—Giovanna C Wright

(57) ABSTRACT

An auger and hole stabilization combination system includes an auger bit that has a bottom end, a top end, and at least one boring blade positioned between the top and bottom ends. A cylinder has an upper end and a lower end. The cylinder has an inner diameter greater than an outer diameter of the auger bit. A coupler releasably couples the auger bit to the cylinder. The auger is extended into a ground surface and the cylinder retained within a hole dug by the auger while a post is placed in the hole.

3 Claims, 5 Drawing Sheets

42
40
42

30
26
22
28
30

AUGER AND HOLE STABILIZATION COMBINATION SYSTEM

BACKGROUND OF THE INVENTION

Field of the Invention

The present invention relates to hole stabilizing devices and more particularly pertains to a new hole stabilizing device for preventing a hole from collapsing after it has been created with an auger.

SUMMARY OF THE INVENTION

The present invention meets the needs presented above by generally comprising an auger bit that has a bottom end, a top end, and at least one boring blade positioned between the top and bottom ends. A cylinder has an upper end and a lower end. The cylinder has an inner diameter greater than an outer diameter of the auger bit. A coupler releasably couples the auger bit to the cylinder. The auger is extended into a ground surface and the cylinder retained within a hole dug by the auger while a post is placed in the hole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
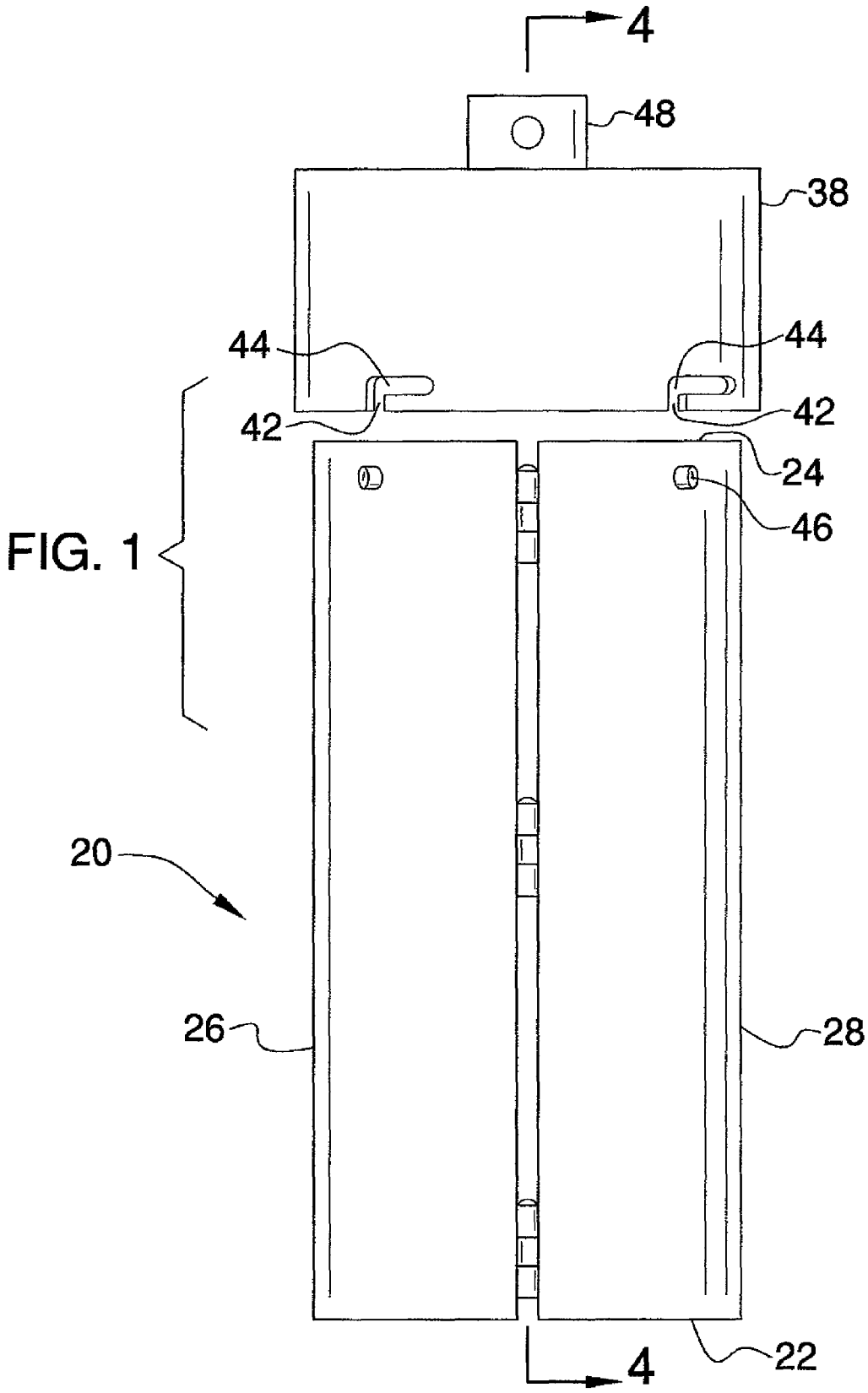
FIG. 1 is a front view of a auger and hole stabilization combination system according to the present invention.
Figure 2:
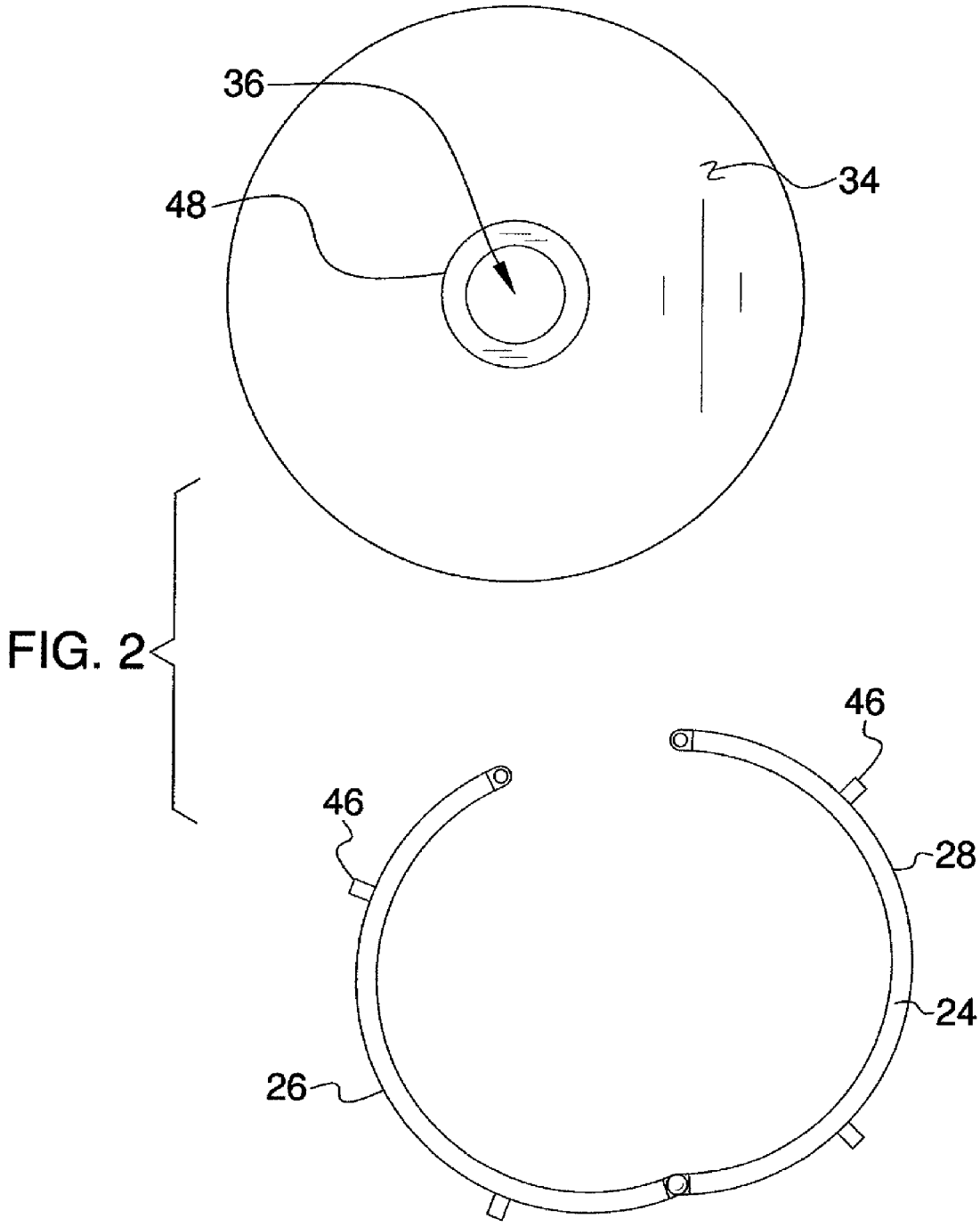
FIG. 2 is a top view of the present invention.
Figure 3:
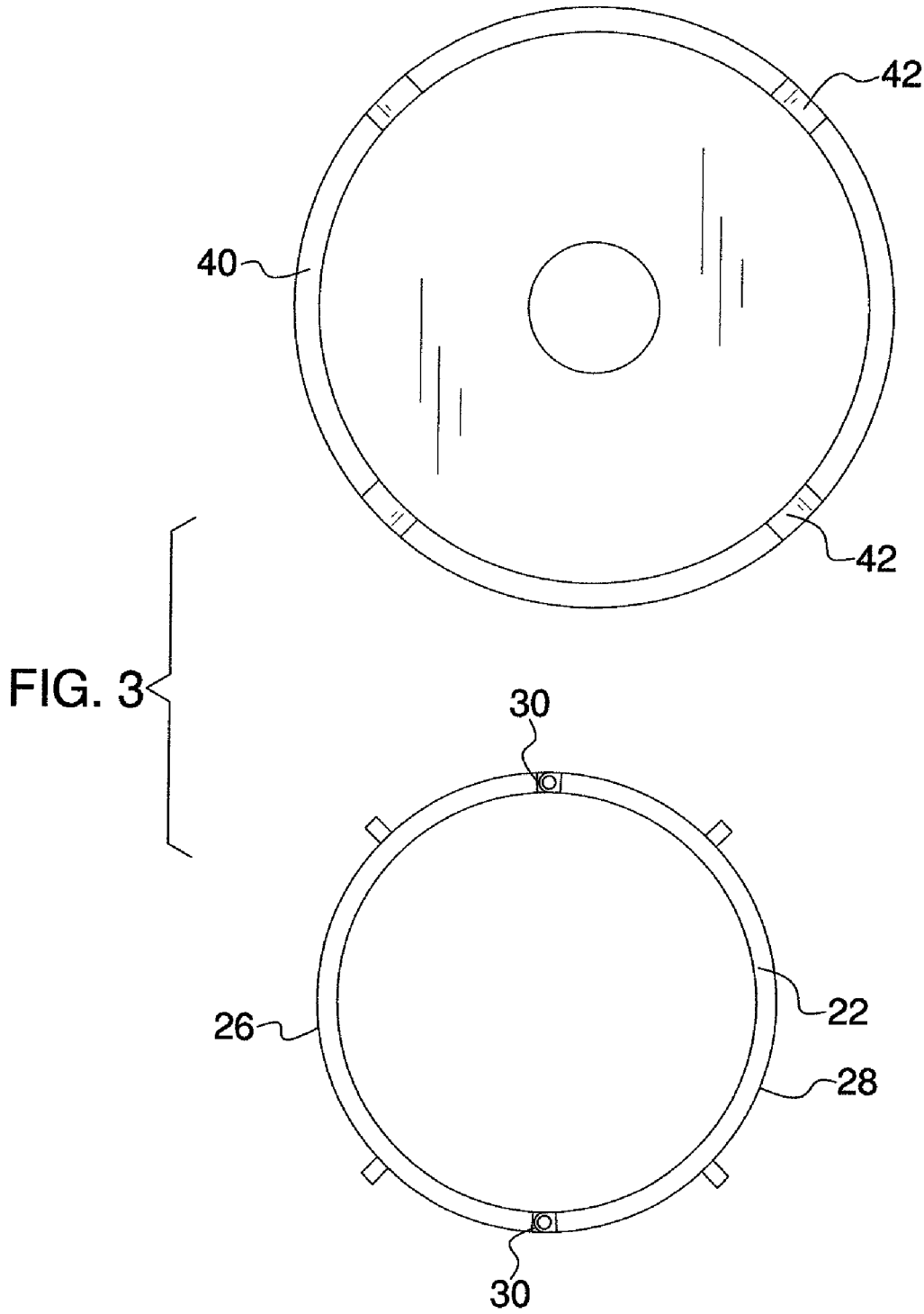
FIG. 3 is a bottom view of the present invention.
Figure 4:
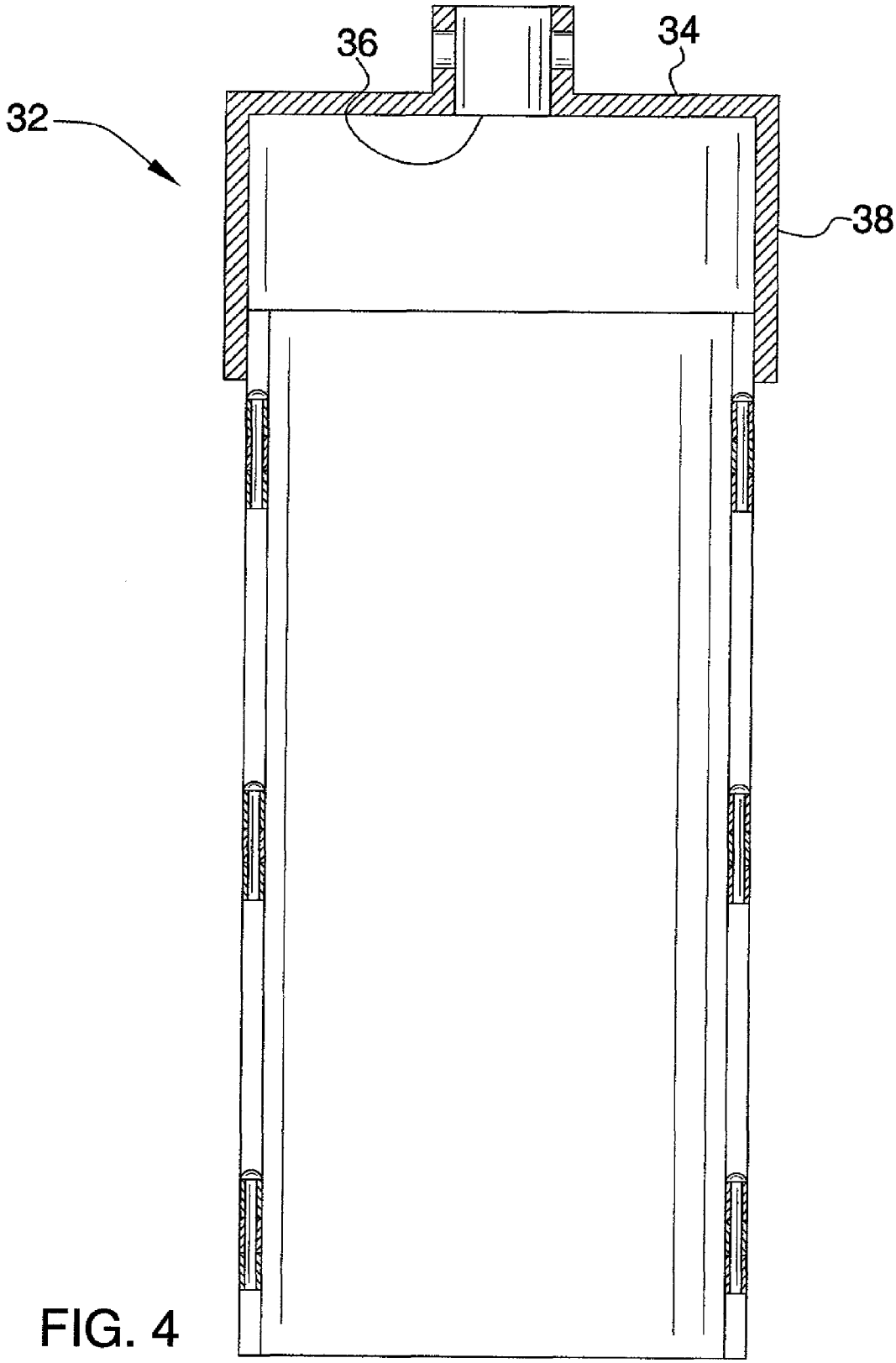
FIG. 4 is a cross-sectional view taken along line 4-4 of FIG. 1 of the present invention.
Figure 5:
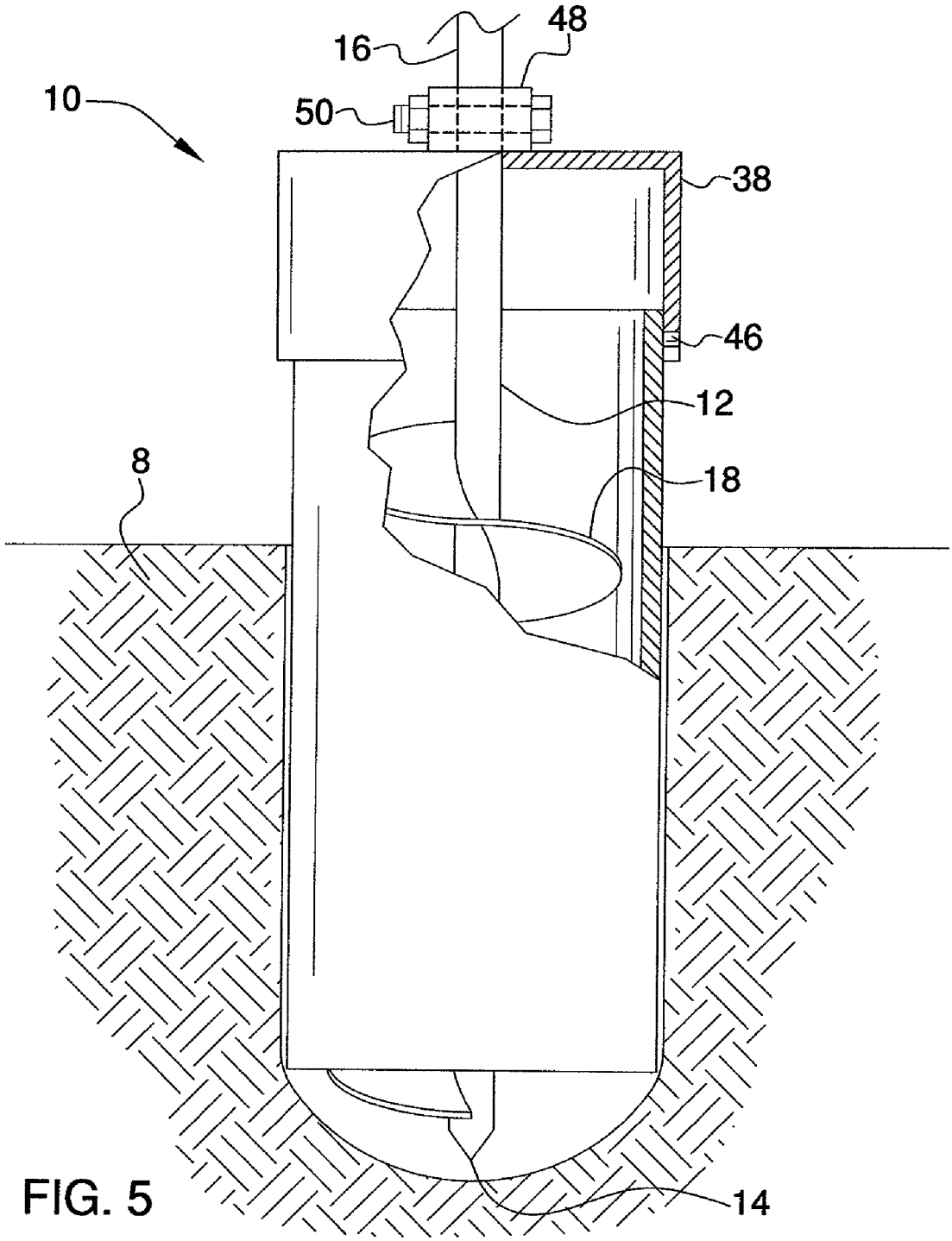
FIG. 5 is a broken side in-use view of the present invention.

With reference now to the drawings, and in particular to FIGS. 1 through 5 thereof, a new hole stabilizing device embodying the principles and concepts of the present invention and generally designated by the reference numeral 10 will be described.

As best illustrated in FIGS. 1 through 5, the auger and hole stabilization combination system 10 generally comprises a conventional auger bit 12 that has a bottom end 14, a top end 16, and at least one boring blade 18 positioned between the top 16 and bottom 14 ends. The auger bit 12 will be coupled to a conventional drive mechanism, not shown, to rotate the auger bit 12.

A cylinder 20 has an upper end 22 and a lower end 24. The cylinder has 20 an inner diameter greater than an outer diameter of the auger bit 12. The cylinder 20 is divided into a first section 26 and a second section 28 along dividing lines 30 extending between the upper 22 and lower 24 ends. The first 26 and second 28 sections are hingedly coupled together and are selectively opened or closed. The cylinder 20 has a height greater than 2 feet and less than 10 feet.

A coupler 32 releasably couples the auger bit 12 to the cylinder 20. The coupler 32 includes a top wall 34 that has an aperture 36 therein and through which the auger bit 12 extends. A perimeter wall 38 is attached to and extends downwardly from the top wall 34. The perimeter wall 38 is cylindrical and receives the upper end 24 of the cylinder 20. The perimeter wall 38 is removably coupled to the cylinder 30. The perimeter wall 38 has a bottom edge 40 having a plurality of notches 42 extending therein. The notches 42 each have a bend 44 therein. A plurality of posts 46 is attached to the cylinder 20 adjacent to the upper end 24. Each of the posts 46 is positioned to be removably extended into one of the notches 42 to attach the cylinder 20 to the perimeter wall 38. The bend 44 in each of the notches 42 prevents the cylinder 20 from becoming dislodged by rotation of the auger bit 12. A shoulder 48 is attached to the top wall 34 and extends upwardly from the top wall 34. The shoulder 48 is coextensive with a perimeter edge of the aperture 36. A locking pin 50 is extended through the shoulder 48 and the auger bit 12 to secure the two together and so that the coupler 32 rotates with the auger bit 12.

In use, the coupler 32 is mounted on the auger bit 12 and the cylinder 20 is then attached to the coupler 32. The auger bit 12 is then used in a conventional manner to drill a hole in a ground surface 8. As the auger bit 12 extends into the ground surface 8 the cylinder moves 20 with the auger bit 12 and abuts the edge of the hole created by the auger bit 12. The cylinder 20 prevents the hole from collapsing, which is particularly useful when used in soil having a high concentration of sand or other loose material. A post, which may comprise a telephone pole, fence post or any item to be erected, is then placed in the cylinder 20 after the auger bit 12 is removed from the cylinder 20. The cylinder 20 is then lifted out of the hole and opened up to remove it from the post.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An auger and hole stabilizing combination system:

an auger bit having a bottom end, a top end, and at least one boring blade being positioned between said top and bottom ends;

a cylinder having an upper end and a lower end, said cylinder having an inner diameter greater than an outer diameter of said auger bit;

a coupler releasably coupling said auger bit to said cylinder, said coupler including;

a top wall, said top wall having an aperture therein, said auger bit extending through said aperture;

a perimeter wall being attached to and extending downwardly from said top wall, said perimeter wall being cylindrical and receiving said upper end of said cylinder, said perimeter wall being removably coupled to said cylinder, said perimeter wall having a bottom edge having a plurality of notches extending therein, said notches each having a bend therein;

a plurality of posts being attached to said cylinder adjacent to said upper end, each of said posts being positioned to be removably extended into one of said notches to attach said cylinder to said perimeter wall;

a shoulder being attached to said top wall and extending upwardly from said top wall, said shoulder being coextensive with a perimeter edge of said aperture;

a locking pin being extended through said shoulder and said auger; and wherein said auger is extended into a ground surface and said cylinder retained within a hole dug by said auger while a post is placed in the hole.

2. The system according to claim 1, wherein said cylinder is divided into a first section and a second section along dividing lines extending between said upper and lower ends, said first and second sections being hingedly coupled together and being selectively opened or closed.

3. An auger and hole stabilizing combination system:

an auger bit having a bottom end, a top end, and at least one boring blade being positioned between said top and bottom ends;

a cylinder having an upper end and a lower end, said cylinder having an inner diameter greater than an outer diameter of said auger bit, said cylinder being divided into a first section and a second section along dividing lines extending between said upper and lower ends, said first and second sections being hingedly coupled together and being selectively opened or closed;

a coupler releasably coupling said auger bit to said cylinder, said coupler including;

a top wall, said top wall having an aperture therein, said auger bit extending through said aperture;

a perimeter wall being attached to and extending downwardly from said top wall, said perimeter wall being cylindrical and receiving said upper end of said cylinder, said perimeter wall being removably coupled to said cylinder, said perimeter wall having a bottom edge having a plurality of notches extending therein, said notches each having a bend therein;

a plurality of posts being attached to said cylinder adjacent to said upper end, each of said posts being positioned to be removably extended into one of said notches to attach said cylinder to said perimeter wall;

a shoulder being attached to said top wall and extending upwardly from said top wall, said shoulder being coextensive with a perimeter edge of said aperture;

a locking pin being extended through said shoulder and said auger; and wherein said auger is extended into a ground surface and said cylinder retained within a hole dug by said auger while a post is placed in the hole.

* * * * *